United States Patent [19]

Economopoulos

[11] 4,046,599

[45] Sept. 6, 1977

[54] PROCESSING WIRE ROD

[75] Inventor: Mario Economopoulos, Liege, Belgium

[73] Assignee: Centre de Recherches Metallurgiques-Centrum Voor Research in de Metallurgie, Brussels, Belgium

[21] Appl. No.: 646,887

[22] Filed: Jan. 6, 1976

[30] Foreign Application Priority Data

Jan. 10, 1975 Belgium ..... 824313

[51] Int. Cl.[2] ..... C21D 9/52

[52] U.S. Cl. ..... 148/12 B; 134/14

[58] Field of Search ..... 148/12 B; 134/14

[56] References Cited

U.S. PATENT DOCUMENTS

| | | | |
|---|---|---|---|
| 2,673,820 | 3/1954 | Morgan | 148/12 B |
| 2,994,328 | 8/1961 | Lewis | 134/57 |

*Primary Examiner*—W. Stallard

*Attorney, Agent, or Firm*—Holman & Stern

[57] ABSTRACT

Steel wire rod leaving the last stand of a rolling mill is quenched to between 850° C and a temperature corresponding to the nose of the curve representing the start of the transformation of austenite to ferrite-pearlite plotted with respect to time and temperature. The wire rod is then subjected to a second cooling while in the form of loose turns passing along a given path. The variation of the temperature of the wire rod along this path is observed, and the position is detected at which a temperature increase occurs owing to recalescence. At this position the wire rod is subjected to supplementary cooling.

5 Claims, No Drawings

PROCESSING WIRE ROD

BACKGROUND OF THE INVENTION

The present invention relates to a method of processing wire rod emerging from a hot rolling mill.

The quality of the wire rod depends on various conditions of the wire rod, among which the following, for example, should be mentioned, i.e. dimensions and shape of the cross section of the wire rod, cleanliness of the steel used and particularly absence of inclusions, mechanical properties of the wire rod, particularly its suitability for wiredrawing, in view of the microstructure of the steel used, the transverse and longitudinal homogeneity of the microstructure, and finally the appearance of the rod surface and particularly its possible state of oxidation.

Among the conditions governing the end quality of wire rod, the nature of the scale, the microstructure of the rod, and the homogeneity of the microstructure depend, for a given steel composition, almost exclusively on the treatment undergone by the rod in the last stand of the rolling mill and the course of cooling at the outlet of the rolling mill. Performing such cooling is precisely the problem for which numerous solutions have been suggested.

Rolled rod for drawing generally undergoes a patenting treatment to impart to the wire rod a structure suitable for the drawing operation. Patenting is often carried out at the wire drawing mill. Such treatment is expensive, particularly when applied to small amounts of wire rod and when dealing with wire rod which for certain uses has to undergo two patenting treatments, one at the supply diameter and the other before reaching the final sizes.

To eliminate the patenting operations, which besides being expensive are also inconvenient, numerous procedures for manufacturing steel wire have been suggested. Sometimes the first patenting treatment (pre-patenting) which is applied to the wire rod obtained by hot rolling, can be eliminated by providing suitable cooling at the outlet of the rolling mill. The procedures suggested for performing such cooling are of various types, some of which use special techniques (e.g. fluidizied bed). Most of them, however, comprise a sudden cooling stage followed by a less steep temperature decrease stage sometimes approximating to isothermal treatment.

With the best known suggested procedures, most of which are applied on industrial scale, close or tight coils are no longer formed. The wire rod is instead arranged either flat or vertically in expanded form, i.e. as loose turns. The successive turns of rod are for example displaced on a conveyor on which a liquid coolant is directed or through which a gaseous coolant is blown. The most interesting procedures of this type known at present are generally carried out with wire rod of hard steel (i.e. steel whose carbon content is 0.4 to 0.85%) and allow only the above-mentioned pre-patenting to be eliminated. These procedures reduce the thickness of the layer of scale formed on the wire rod, and they ensure acceptable longitudinal homogeneity of the wire, although it is still inferior to that achievable by patenting, particularly lead patenting.

Generally speaking, controlled cooling procedures are carried out by following a course derived from CCT (continuous cooling-transformation) or TTT (temperature-time-transformation) diagrams in which well-known curves of beginning and end of the transformation of austenite to ferrite-pearlite are plotted against time and temperature. This course is usually chosen in such a way that the transformation commences at a temperature slightly higher than that corresponding to the nose of the curve representing the start of the transformation of the austenite to ferrite-pearlite and is achieved at a temperature substantially equal to that corresponding to the nose of the curve representing the end of the transformation. In this manner, pre-eutectoid ferrite as well as bainite and martensite are prevented at the utmost from being formed.

However, the controlled or regulated cooling procedures known at present are inconvenient because of the practical difficulty of achieving with sufficient certainty the chosen starting point and ending point of the transformation on the CCT or TTT diagram. This difficulty is due to several facts and particularly to the fact that, since the transformation of steel is exothermic, the temperature of the wire rod rises during the transformation, this phenomenon being known as recalescence.

SUMMARY OF THE INVENTION

The present invention provides a method in which the wire rod emerging from the last stand of a rolling mill is suddenly cooled to between 850° C and a temperature substantially equal to the temperature corresponding to the nose of the curve corresponding to the start of the transformation of austenite to ferrite-pearlite, and in which the wire rod in not-closed turns then undergoes a second cooling to complete the transformation, characterized in that the cooling course is determined during the transformation of the steel, the temperature increase owing to the exothermic character of the phenomenon called recalescence is determined, and supplementary cooling is provided along the wire rod path where the temperature increase occurs. The intensity of the cooling is adjusted particularly as a function of the properties of the wire rod and the composition of the steel.

DETAILED DESCRIPTION OF PREFERRED EMBODIMENT

The cooling course of the wire rod during the transformation of the steel is preferably determined by means of a scanning pyrometer, whose range preferably covers at least the upstream half of a conveyor carrying the wire rod.

Preferably, data provided by a device for determining the cooling course of the wire rod are continuously recorded by recording apparatus connected to a control device for performing the supplementary cooling.

Detection of the temperature increase due to recalescence implies both determination of the place where the temperature increase occurs and measurement of the recalescence.

The method according to the invention is applicable irrespective of the arrangement of the loose turns of wire rod, e.g. concentric turns with a horizontal or non-horizontal axis or turns distributed in a non-concentric manner along a conveyor. Moreover, its application extends to all procedures of controlled general cooling, whether provided by air blowing, for example from below upwards through distributed turns, or simply in still air.

In a particular example of performing the method in which general cooling for ensuring the steel transformation occurs by means of fans located under a conveyor carrying the turns of wire rod, devices for forming a mist are arranged in air chambers designed to distribute air and can be constituted in particular by a plurality of parallel nozzles having orifices for atomizing water in the air being blown.

The supplementary cooling means for atomizing water can of course also be used in the case where the turns of wire rod are continuously displaced parallel to their horizontal axis.

This particular mode of supplementary cooling of the wire rod has been found to be very flexible, owing to the formation of a localized mist. The easy control of the beginning and termination of such a mist, by means of the nozzles described above, also permits automatic control and very simple intensity regulation.

I claim:

1. In a method of processing steel wire rod leaving the last stand of a rolling mill, comprising the sequential steps of rapidly cooling the wire rod down to between 850° C and a temperature corresponding to the nose of the curve representing the start of transformation of austenite to ferrite-pearlite in a diagram in which curves representing the start and finish of transformations in the steel are plotted with respect to time and temperature, and subjecting the wire rod to a second cooling while the rod is in the form of loose turns passing along a given path, during which second cooling the steel completely transforms from austenite to ferrite-pearlite, the improvement comprising observing the variation of the temperature of the wire rod along the given path, detecting the position at which a temperature increase occurs owing to recalescence, and subjecting the wire rod to localized supplementary cooling at the position.

2. The method as claimed in claim 1, in which the temperature of the wire rod on the given path is observed by means of a scanning pyrometer.

3. The method as claimed in claim 1, furher comprising automatically recording the variation of the temperature of the wire rod along the given path continuously by means of recording apparatus, the recording apparatus being connected to control means for controlling the supplementary cooling.

4. The method as claimed in claim 1, in which the supplementary cooling is carried out by cooling means comprising a plurality of parallel nozzles with orifices for atomizing water in air.

5. The method as claimed in claim 1, in which the second cooling is carried out by blowing air upwards through air distribution chambers and through a conveyor carrying the turns of wire rod, by means of fans located under the conveyor, cooling means for forming a mist being arranged in the air chambers.

* * * * *